United States Patent [19]

Scott

[11] 3,958,737

[45] May 25, 1976

[54] ADJUSTABLE FEED MECHANISM

[75] Inventor: Eldred D. Scott, Tustin, Calif.

[73] Assignee: Precision Sales Corporation, Reno, Nev.

[22] Filed: Dec. 9, 1974

[21] Appl. No.: 530,650

Related U.S. Application Data

[62] Division of Ser. No. 402,290, Oct. 1, 1973, Pat. No. 3,863,534.

[52] U.S. Cl. ..... 226/142; 226/156

[51] Int. Cl.[2] ..... B65H 17/26

[58] Field of Search ..... 226/139, 142, 156, 141

[56] References Cited

UNITED STATES PATENTS 2,262,915 11/1941 Bobst ..... 226/142

3,076,368 2/1963 Groll ..... 226/156 X

*Primary Examiner*—Richard A. Schacher

*Attorney, Agent, or Firm*—Gordon L. Peterson

[57] ABSTRACT

A feeding mechanism for feeding material to a machine comprising a supporting structure, a drive roll rotatably mounted on the supporting structure, a second roll rotatably mounted on the supporting structure, a drive lever mounted for pivotal movement in both directions about a pivotal axis, a one-way clutch for coupling the drive lever to the drive roll, an adjustable stop for limiting the pivotal movement of the drive lever in one direction, and a resilient member for driving the drive lever in said one direction.

5 Claims, 13 Drawing Figures

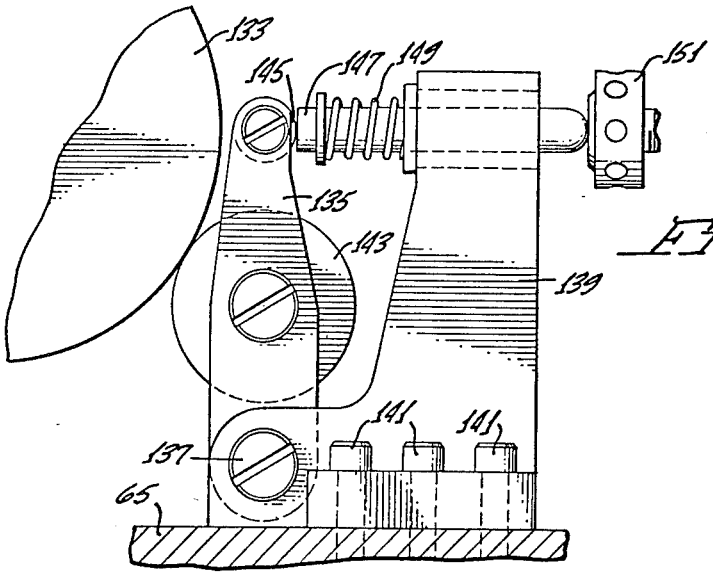
FIG. 8.
FIG. 9.
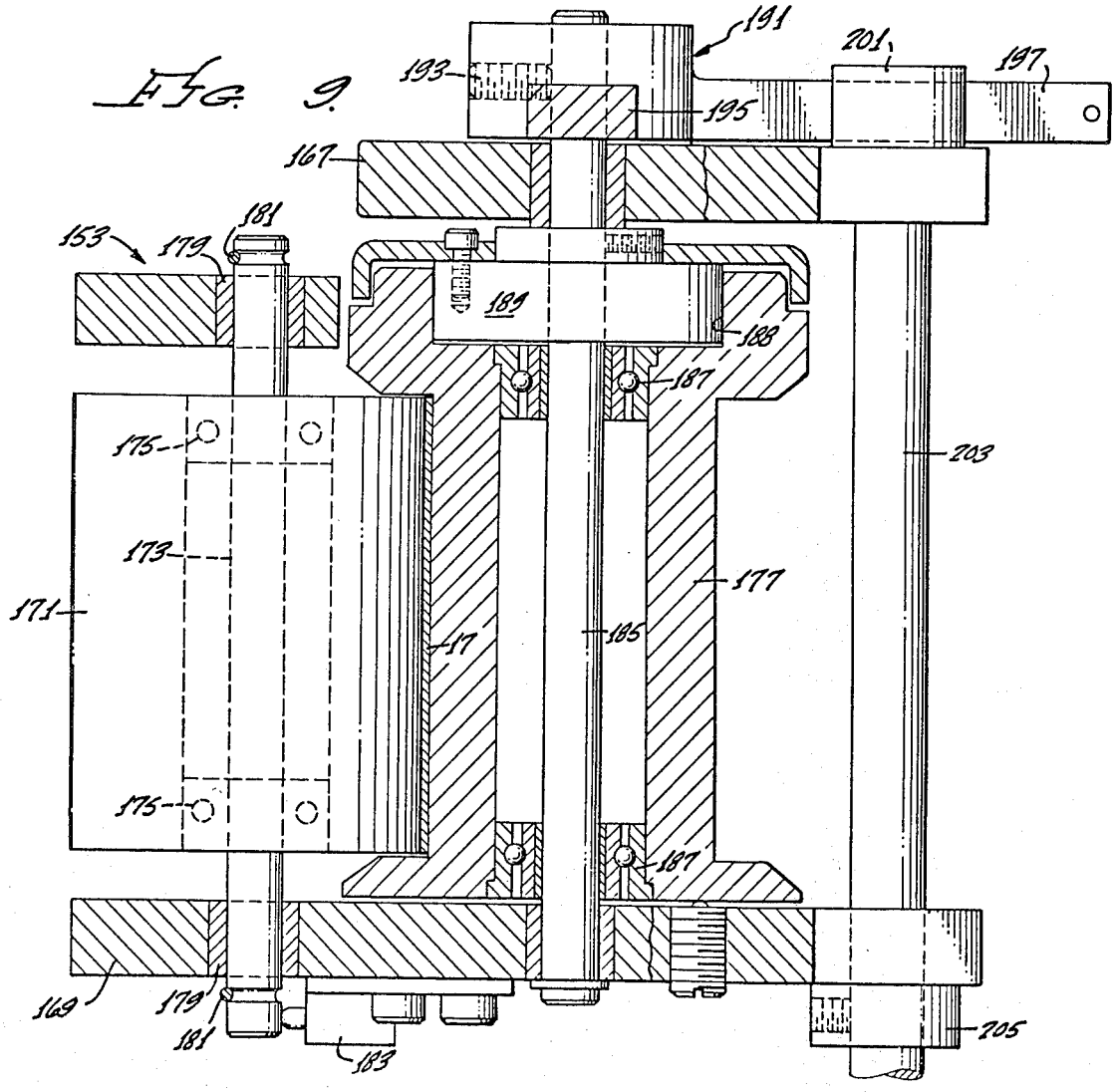

ADJUSTABLE FEED MECHANISM

This is a division of application Ser. No. 402,290 filed Oct. 1, 1973, now U.S. Pat. No. 3,863,534.

BACKGROUND OF THE INVENTION

One application of a stamping press is in the manufacture of memory cores from tape such as a ferrite tape. Each core is formed by a suitable set of tooling which blanks out the core from the tape leaving an opening in the tape. The tooling also forms an aperture in the core.

After the core is made, it must be removed from the press and transferred to a collection point. One way of doing this is to put the core back into the opening in the tape as shown by way of example in the Riggi U.S. Pat. No. 3,610,082. The core is then moved out of the press as the tape is indexed through the press. One problem with this method is that putting the core back into the tape tends to deform the core, and this has an adverse effect upon it.

Another way of getting the core out of the press is to blow it into an adjacent chute as shown for example in Wiechec U.S. Pat. No. 3,568,554. In actual practice, a core press may have many sets of tooling so that, for each operation of the press, many cores are formed. It is necessary or desirable to separately collect the cores formed by each set of tooling so that, if one set of tooling is making unacceptable cores, these unacceptable cores will be automatically segregated from the acceptable cores. The type of chute collection shown in the Wiechec patent makes separate collection of cores from each set of tooling difficult or impossible.

SUMMARY OF THE INVENTION

The present invention provides a press possessing many novel features, one of which is the solution of the core removal problem discussed above. The present invention employs a novel die plate having passage sections for removal and separate collection of the cores formed by the press. In addition, the die plate includes a portion of the tooling utilized in making the cores and forms a guide for another portion of such tooling.

More specifically, the die plate may have first and second passages extending completely therethrough with one end of each of the passages defining a core die. The die plate also has first and second passage sections intersecting the first and second passsages at first and second intersections, respectively. The intersections are intermediate the ends of the first and second passages. The passage sections extend to different locations on the periphery of the die plate and thus perform core removal and separation functions.

The tooling means utilized to make the cores includes the core dies. The tooling means also must position the finished cores at the above-mentioned intersections so that the cores can be removed from the press.

The tooling means can take different forms. However, it may include a plurality of core or O.D. punches cooperable with the core dies to blank out the cores from the tape. Each of the core punches has a recess therein defining an aperture die. The tooling means also includes aperture or I.D. punches receivable in the passages, respectively, of the die plate and cooperable with the aperture dies to form the apertures in the cores.

Another feature of the die plate is that it guides the aperture punches. Ostensibly this function is easy to implement; however, several factors relating to core manufacture make it most difficult. Specifically, memory cores are extremely small, typically being of the order of 0.020 inch outside diameter, .015 inch inside diameter, and 0.006 inch thick. In addition, near perfect concentricity between the inner and outer circular peripheries of the core is absolutely essential. To assure proper concentricity, the passage through the die plate must be of constant diameter and not be stepped. However, if the passage is of constant diameter and if the die plate is to guide the aperture punch, then the aperture punch must be stepped. Unfortunately, stepped punches of very small diameter are extremely difficult to make.

With the present invention, a stepped bore having the necessary concentricity is obtained by first forming a cylindrical bore completely through the die plate and then inserting an accurately formed sleeve iinto one end of the passage. The sleeve provides diameter reduction and the necessary concentricity and serves to guide the aperture punch.

For a press of this type, it is essential that the stroke of the tooling be adjustable. The press is preferably cam driven and, accordingly, it is necessary that the adjustment be made without upsetting the timing relationship between the cam and cam follower. With the present invention this is advantageously accomplished by providing an arm mounted on the supporting structure of the press for pivotal movement about a pivot axis. A cam follower is carried by the arm and engaged by the cam so that the cam can pivot the arm about the pivot axis. The tooling to be driven by this cam is carried by a platen. Variable length means drivingly couple the arm and the platen so that the cam can drive the platen. The length of the variable length means can be changed to alter the stroke of the platen and the tooling without pivoting the arm or altering the driving relationship between the cam and the cam follower.

It is desirable to employ two identical cams to drive one of the platens of the press. Two cams are desirable so that a direct driving force can be applied to both ends of the platen. This, however, creates the problem of how to make accurate identical adjustments of the motion derivable from both cams. With the present invention, this is accomplished by employing a yoke and mounting the yoke on a plate which in turn is drivingly coupled to the platen. By adjusting the angular position of the yoke about its pivot axis relative to the plate, the positions of both of the cam followers relative to the plate can be accurately and simultaneously adjusted to thereby make an adjustment in the stroke of the platen.

A press of the type to which the present invention is directed must have a stock feeding apparatus for indexing the stock or material through the press. It may become necessary to adjust the feed rate of the stock feeding mechanism. Although prior art mechanisms provide this adjustment feature, it is necessary to shut down the press and the feeding mechanism to make the adjustment. One feature of this invention is that this adjustment can be made without shutting down the press or the stock feeding mechanism.

The feeding mechanism can advantageously include a drive roll and an idler roll, both of which are rotatably mounted on suitable supporting structure. A drive lever is mounted for pivotal movement in both directions about a pivotal axis. The drive lever is coupled to the drive roll through a one-way clutch so that the drive lever can rotate the drive roll in only one direction. The length of stroke of the drive lever is variable to thereby vary the feed rate.

To allow for variation in the length of the stroke of the drive lever without interfering with the drive mechanism for the drive lever, the lever can advantageously be driven in one direction by resilient means. In a preferred embodiment, the adjustable means includes an eccentric and the drive lever is driven into engagement with the eccentric by the resilient means.

The invention can best be understood by reference to the following description taken in connection with the accompanying illustrative drawings.

BRIEF DESCRIPTION OF THE DRAWINGS

FIG. 8 is an enlarged fragmentary view partially in section illustrating the driving mechanism for the aperture punch platen.

FIG. 9 is an enlarged sectional view taken generally along line 9—9 of FIG. 3 and illustrating the stock feeding mechanism.

DESCRIPTION OF THE PREFERRED EMBODIMENTS

The Tooling and Die Plate

Figures 1A, 1B, 1C, 1D, 1E, 4:
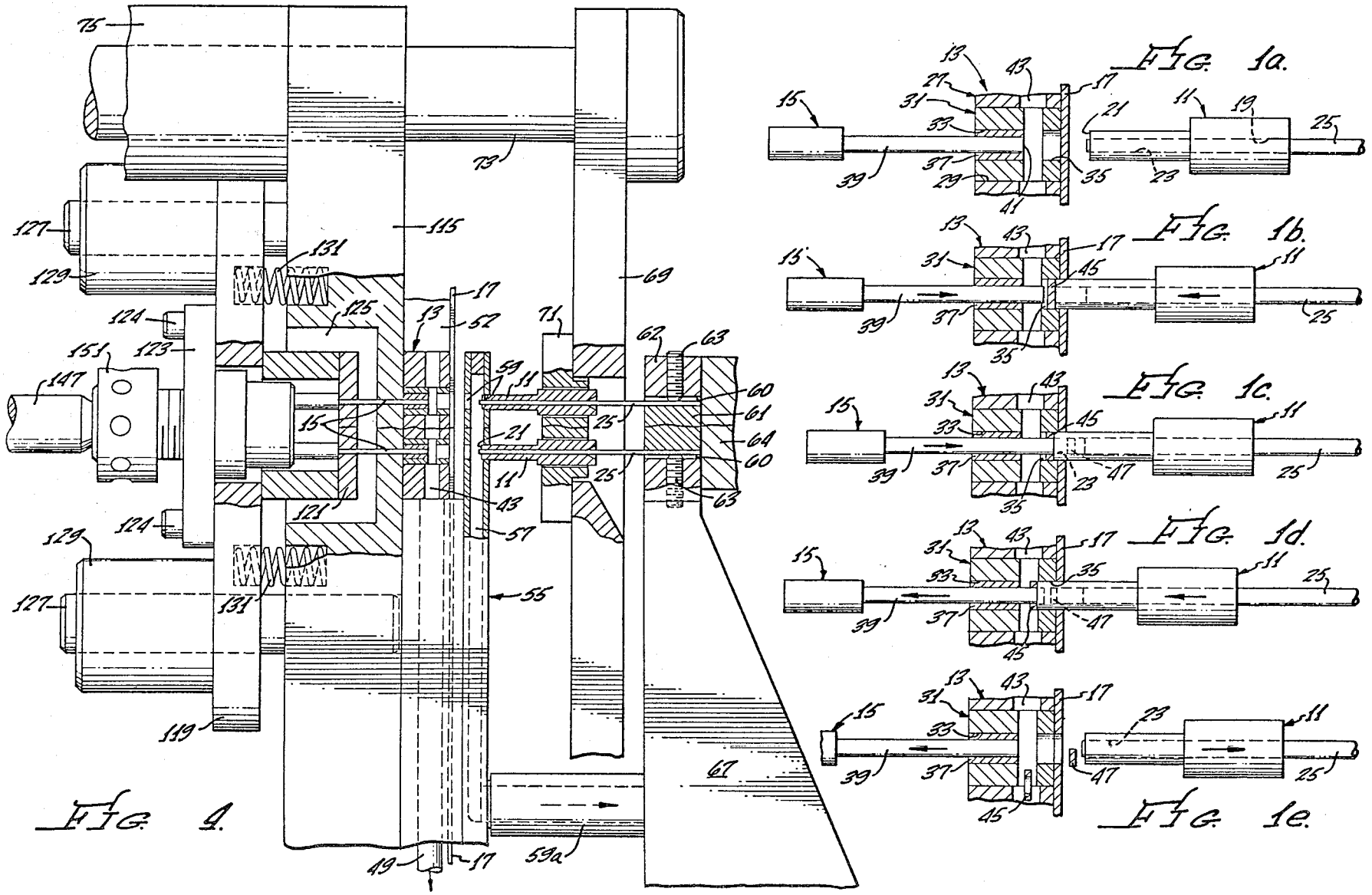
FIGS. 1A–1E are somewhat simplified, fragmentary, elevational views partially in section of one set of tooling showing the sequence of operations in making a core.
FIG. 4 is an enlarged elevational view partially in section of a portion of the press shown in FIG. 3 illustrating, among other things, the tooling and the platens.

One example of the work operations which can be advantageously carried out with the present invention is illustrated in FIGS. 1A–1E. Generally FIG. 1A shows a core punch 11, a die plate 13, and an aperture punch 15. Ferrite tape 17 is interposed between the core punch 11 and the die plate 13. The ferrite tape 17 is supplied in a thin elongated strip and is of the type suitable for the manufacture of memory cores. Although this invention includes many features particularly adapted to the manufacture of memory cores, it is not so limited, and the tooling shown in FIG. 1A can be utilized to stamp parts from any relatively thin material including strip stock and sheet material.

The core punch 11 is tubular and has a cylindrical axial bore extending therethrough and opening at an annular working face 21 of the core punch. The end of the bore 19 adjacent the working face 21 defines an aperture die 23. A stationary ejector 25 extends completely through the bore 19 in the position of the core punch 11 shown in FIG. 1A.

Figure 7:
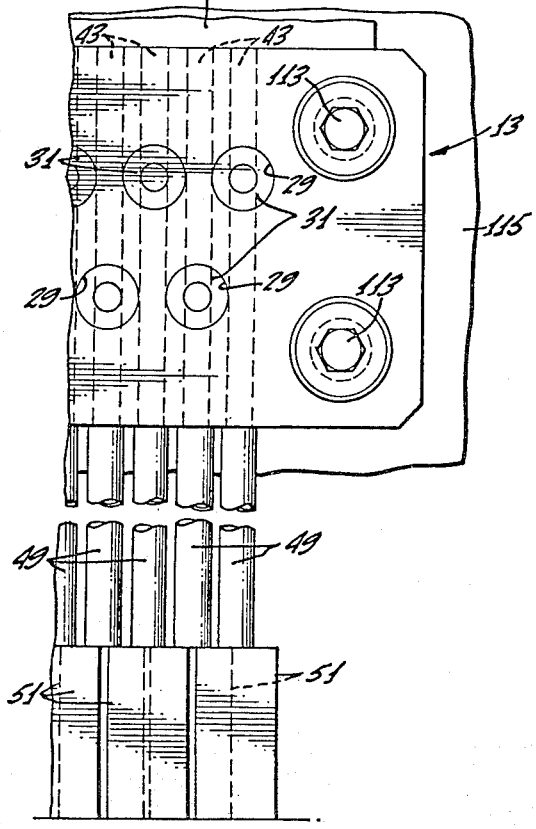
FIG. 7 is an enlarged fragmentary sectional view taken generally along lines 7—7 of FIG. 3 and illustrating the die plate and the means for separately collecting the cores made by the press.
Figure 6:
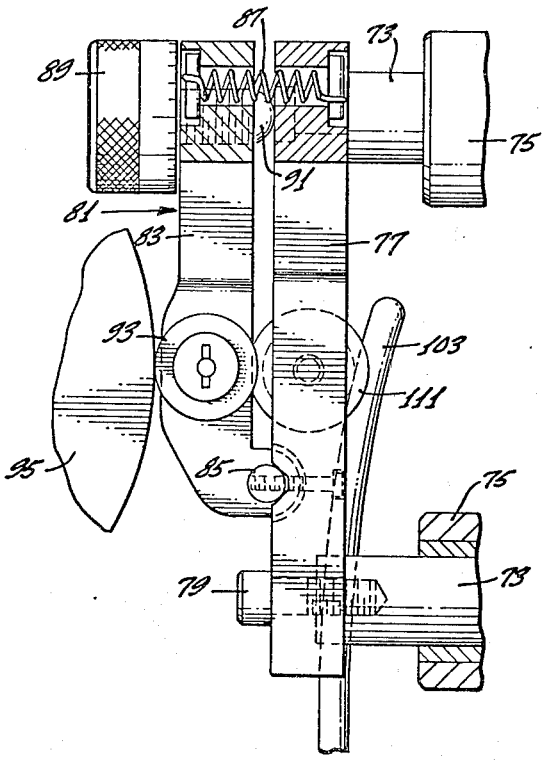
FIG. 6 is a fragmentary sectional view taken generally along lines 6—6 of FIG. 5.

The die plate 13 includes a plate-like body 27 having a plurality of cylindrical bores 29 (only one being shown in FIG. 1A) extending between the opposed faces of the body. The die plate 13 includes a plurality of die buttons 31, one being fixed within each of the bores 29 (FIGS. 1A and 7). Each of the die buttons 31 has a cylindrical axial bore 33 extending between the faces of the die plate 13 with the end of the bore 33 adjacent the tape 17 defining a cylindrical core die 35. The core die 35 is coaxial with the core punch 11 and is sized to receive the core punch therein. An insert in the form of an accurately constructed sleeve 37 is suitably ridigly affixed within the end of the bore 33 remote from the core die 35. The die button 31 and the sleeve 37 are preferably constructed of hard, wear-resistant material such as carbide.

The sleeve 37 has a cylindrical passage therein concentric with the cylindrical core die 35 and of smaller diameter. The sleeve 37 and the portion of the bore 33 which does not contain the sleeve cooperate to define a passage through the die plate 13.

The aperture punch 15 has a cylindrical shank 39 which is slidably received in and guided by the sleeve 37. The shank 39 terminates in a circular working face 41.

As best shown in FIG. 7, the die plate 13 has a plurality of non-intersecting passage sections 43, one being provided for each of the die buttons 31. Each of the passage sections 43 is vertical and terminates at a different location on the periphery of the die plate 13. In the embodiment illustrated, the passage sections 43 extend completely through the die plate from one end to the other. Also, the passage sections 43 have vertically extending axes. As shown in FIG. 1A, the passage section 43 includes a passage portion in the body 27 and a passage portion in the die button 31. The passage section 43 intersects the bore 33 intermediate the core die 35 and the sleeve 37.

The die plate 13 may include any number of the die buttons 31. Of course, one core punch 11 and the aperture punch 15 is provided for each of the die buttons 31. One of the die buttons 31 with the associated core punch 11 and the aperture punch 15 forms one complete set of tooling for forming a memory core. In the embodiment illustrated, each set of tooling is identical.

In operation of the tooling, the die plate 13 remains stationary and the core punch 11 and aperture punch 15 reciprocate according to a predetermined program, and the ferrite tape 17 is appropriately indexed. The first step in the operation of the tooling is to advance the core punch 11 and the aperture punch 15 to the position shown in FIG. 1B. This causes the core punch 11 to enter the core die 35 thereby blanking out a core 45 from the tape 17 and placing the core in the core die 35. The advancing movement of the aperture punch 15 serves a prepositioning function to position the punch 15 for the next operation.

Secondly, the core punch 11 is held stationary and the aperture punch 15 is advanced as shown in FIG. 1C, into the aperture die 23. This removes a slug 47 from the core 45 and forms an aperture in the core. The core 45 is accurately formed with the inner and outer peripheries being circular and concentric.

Next, the aperture punch 15 is withdrawn and the core punch 11 is further advanced as shown in FIG. 1D. This causes the core punch 11 to eject the core 45 from the core die 35 and into the intersection of the passage section 43 and the bore 33. The aperture punch 15 withdraws so as not to hinder this ejection movement.

The aperture punch 15 is further withdrawn and the core punch 11 is completely withdrawn from the core die 35 as shown in FIG. 1E. If the core 45 is retained on the aperture punch 15 it will be stripped off when it contacts the sleeve 37.

The core 45 then moves through the passage section 43 and a vertical conduit 49 (FIG. 7) coupled thereto to a container 51. In the embodiment illustrated, the core 45 falls through the passage section 43 under the influence of gravity. One of the containers 51 is provided for each of the conduits 49. Thus, the cores 45 made from each set of tooling are separately collected in separate containers.

Vacuum or positive air pressure may be provided to assist movement of the cores 45 to the containers 51. Pressure greater than atmospheric is preferred because a vacuum in the passage sections 43 tends to suck the slugs 47 into the passage sections. Air pressure can be supplied to the passage sections 43 by an air manifold 52 (FIG. 4).

The slug 47 formed in the operation illustrated in FIG. 1C tends to remain within the aperture die 23. However, the core punch 11 is withdrawn until the slug 47 contacts the end of the ejector 25 whereby the slug is ejected from the aperture die. The slugs 47 can advantageously be collected in a manner described more fully hereinbelow with reference to FIG. 4.

It will be noted that the position of FIG. 1E is identical to the position of FIG. 1A. With the tooling in this position, the tape 17 is appropriately indexed and the above-described operation of the tooling is repeated.

FIGS. 2–9 show a press 53 for operating the core punch 11 and aperture punch 15 in the manner shown in FIGS. 1A–1E. Although the press 53 is particularly adapted for this purpose, it should be understood that many of its features are applicable to the operation of other tooling in different operational sequences. Conversely, the functions illustrated in FIGS. 1A–1E can be carried out with presses of different construction.

SLUG REMOVAL

FIG. 4 shows the core punches 11 and the aperture punches 15 in the same position as in FIGS. 1A and 1E. A collector 55 having a cavity 57 extends into the path of all of the core punches 11 (FIG. 4). The collector 55 has one pair of aligned apertures 59 in the opposite walls thereof for each of the core punches 11 with each of such pair being adapted to receive one of the core punches. The collector 55 is located so that the working faces 21 of the core punches 11 are within the cavity 55 when the slugs 47 are ejected from the associated aperture die 23. Thus, the slugs 47 enter the cavity 55 and fall under the influence of gravity and, if desired, with the assistance of vacuum pressure to a receptacle (not shown). Vacuum pressure may be applied to the cavity 57 via a conduit **59*a* (FIGS. 2 and 4**).

FIG. 4 also shows one way of mounting the ejectors 25. In the embodiment illustrated, each of the ejectors 25 is in the form of an elongated wire which, in the position shown in FIG. 4, projects completely through the associated core punch 11. The ejectors 25 must be sufficiently stiff so as not to buckle in ejecting the slugs 47. The core punches 11 provide some stability for the ejectors 25. The righthand end (as viewed in FIG. 4) of the ejectors 25 is received within grooves 60 formed in a wire support block 61. A frame 62 surrounds the block 61 and set screws 63 in the frame engage the ejectors 25 and retain them in their respective grooves 60. The set screws 63 permit the effective lengths of the ejectors 25 to be adjusted. The ejectors engage a backup plate 64 which is mounted at the right side (as viewed in FIG. 4) of the block 61. Of course, other ejector mounting means could be used.

THE CORE PUNCH DRIVING MECHANISM

Figure 2:
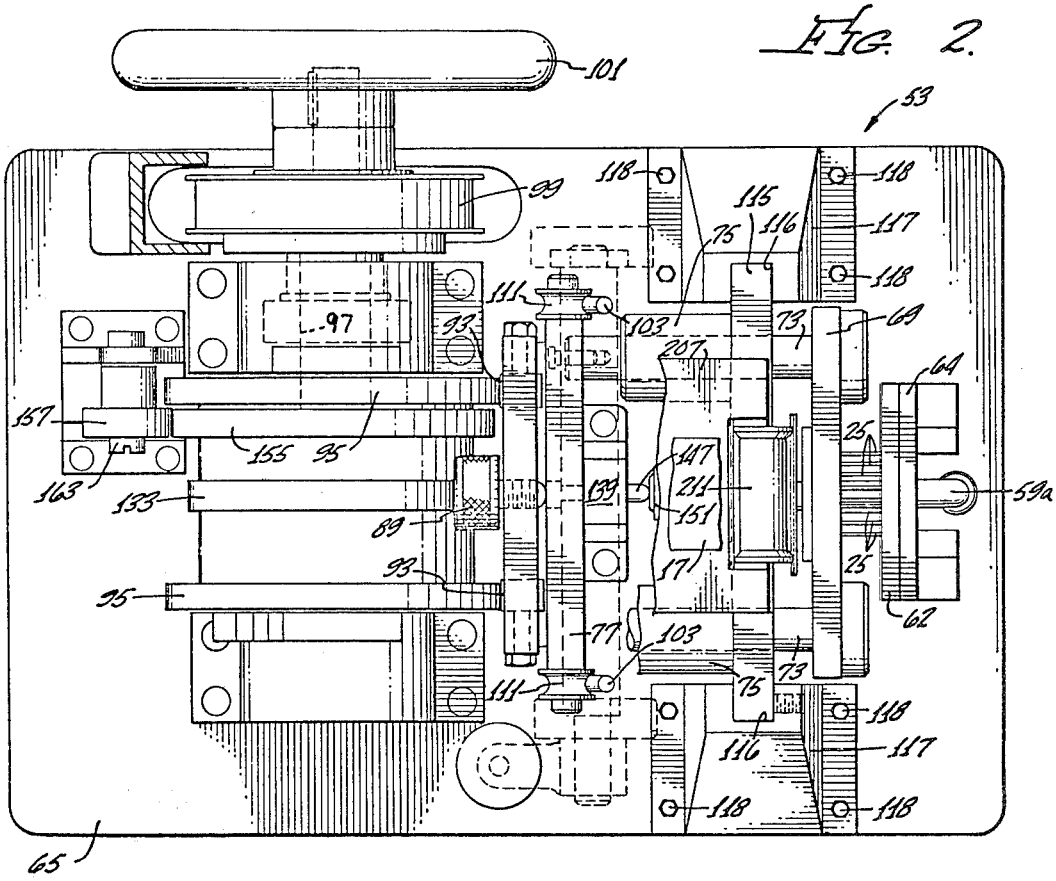
FIG. 2 is a top plan view of a press constructed in accordance with the teachings of this invention.
Figure 3:
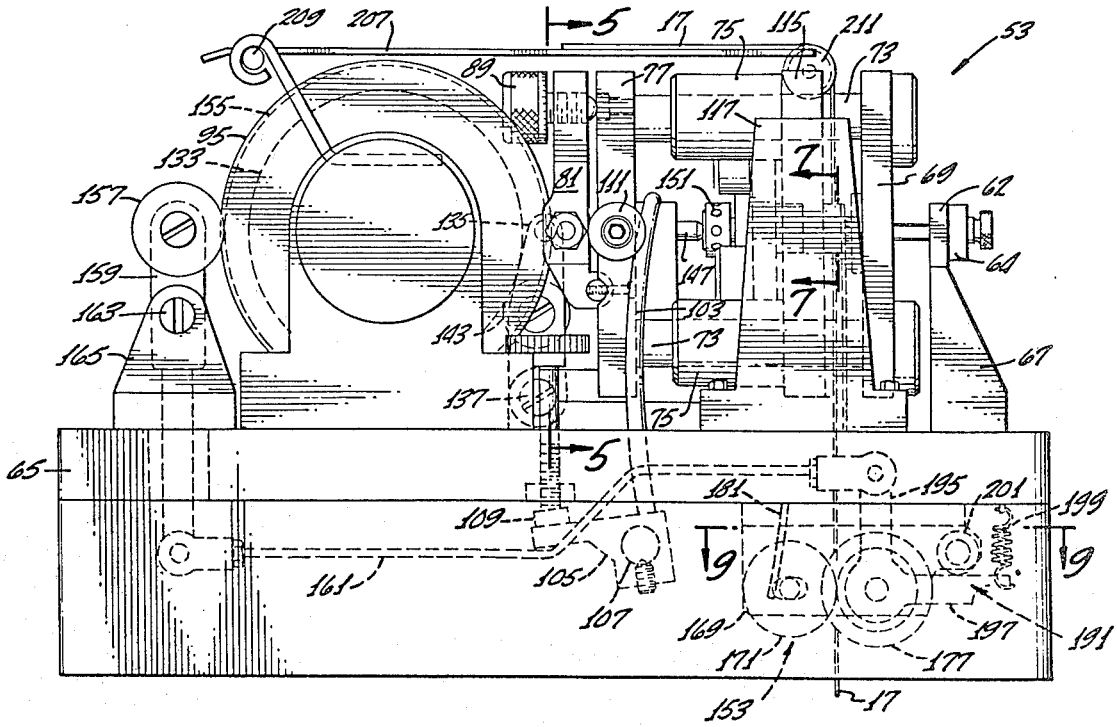
FIG. 3 is a front elevational view of the press.

As shown in FIGS. 2 and 3, the press 53 has a base 65 on which the various components are supported. The base 65 is horizontal in normal operation of the press. The ejector support block 61 is mounted on the base 65 by a bracket 67 (FIGS. 3 and 4).

The core punches 11 (FIG. 4) are mounted on a core punch platen 69 (FIGS. 2–4) by a punch retainer 71 (FIG. 4). The core punches 11 pass through bores in the punch retainer 71 and are affixed to the punch retainer by an adhesive such as an Epoxy adhesive.

The core punch platen 69 lies in a vertical plane and is suitably affixed to four spaced, parallel, horizontal shafts 73. The shafts 73 are supported for horizontal reciprocating movement by four bearings 75, respectively. The bearings 75 are in turn suitably mounted on a main plate 115 (FIGS. 2–4), which in turn are mounted on the base 65 by brackets 117 as described more fully hereinbelow. Accordingly, the core punches 11 and the core punch platen 69 are mounted for reciprocation along a horizontal path relative to the base 65.

A plate 77 (FIGS. 2, 3, 5 and 6) is affixed by screws 79 to the ends of the shafts 73 remote from the platen 69. In the embodiment illustrated, the plate 77 is in a vertical plane and parallel to the core punch platen 69.

A lever in the form of a yoke 81 having spaced arms 83 (FIG. 5) is pivotally mounted on the plate 77 in any suitable manner such as by pins 85 for pivotal movement about a horizontal pivotal axis which is parallel to the plane of the plate 77 and which extends transversely to the axes of the shafts 73. Springs 87 (FIGS. 5 and 6) are affixed to the yoke 81 and the plate 77 urge the yoke clockwise toward the plate 77 as viewed in FIG. 6. An adjusting screw 89 is carried by the end of the yoke 81 remote from the pivot axis of the yoke and has an end portion 91 adapted to bear against the plate 77. By turning of the adjusting screw 89, the angular position of the yoke 81 about its pivot axis relative to the plate 77 can be easily manually adjusted.

Two identical cam followers 93 are rotatably mounted on the arms 83 for rotational movement about aligned, horizontal pivot axes which are parallel to the pivot axis of the yoke 81. The cam followers 93 are driven by two identical cams 95. The cams 95 are mounted on a rotatable shaft 97 (FIG. 2) which in turn is suitably rotatably mounted for rotation about the base 65. The shaft 97 is driven by a timing pulley 99 which is adapted to be driven by a motor and drive train (not shown). The shaft 97 can also be manually rotated by a handwheel 101 (FIG. 2).

The cam followers 93 are maintained in engagement with their respective cams 95 by springs 103 (FIGS. 2, 3, 5 and 6) which are mounted on a spring actuating lever 105 (FIG. 3). The lever 105 is pivotally mounted on a shaft 107 which in turn is mounted on the base 65. The angular position of the lever 105 about its pivot axis can be adjusted by a screw 109 which is threaded into the lower face of the base 65 and which bears against the spring actuating lever.

The springs 103 project upwardly from the base 65 along opposite vertical edges of the plate 77. The springs 103 adjacent their free ends engage spring retainers 111 mounted on the plate 77. Thus, each of the springs 103 is flexed or bent between the spring actuating lever 105 and the associated spring retainer 111. The amount of tension or flexure in each of the springs 103 can be adjusted by turning the screw 109.

In operation, rotation of the cams 95 imparts movement to the core punches 11 as described with reference to FIGS. 1A–1E through the cam followers 93, the yoke 81, the plate 77, the shafts 73, the core punch platen 69, and the punch retainer 71. The springs 103 act against the spring retainers 111 to maintain the cam followers 93 in engagement with the associated cams 95. Thus, the cams 95 drive the core punches 11 to the right as viewed in FIG. 4 and the springs 103 drive the core punches to the left as viewed in FIG. 4.

Figure 5:
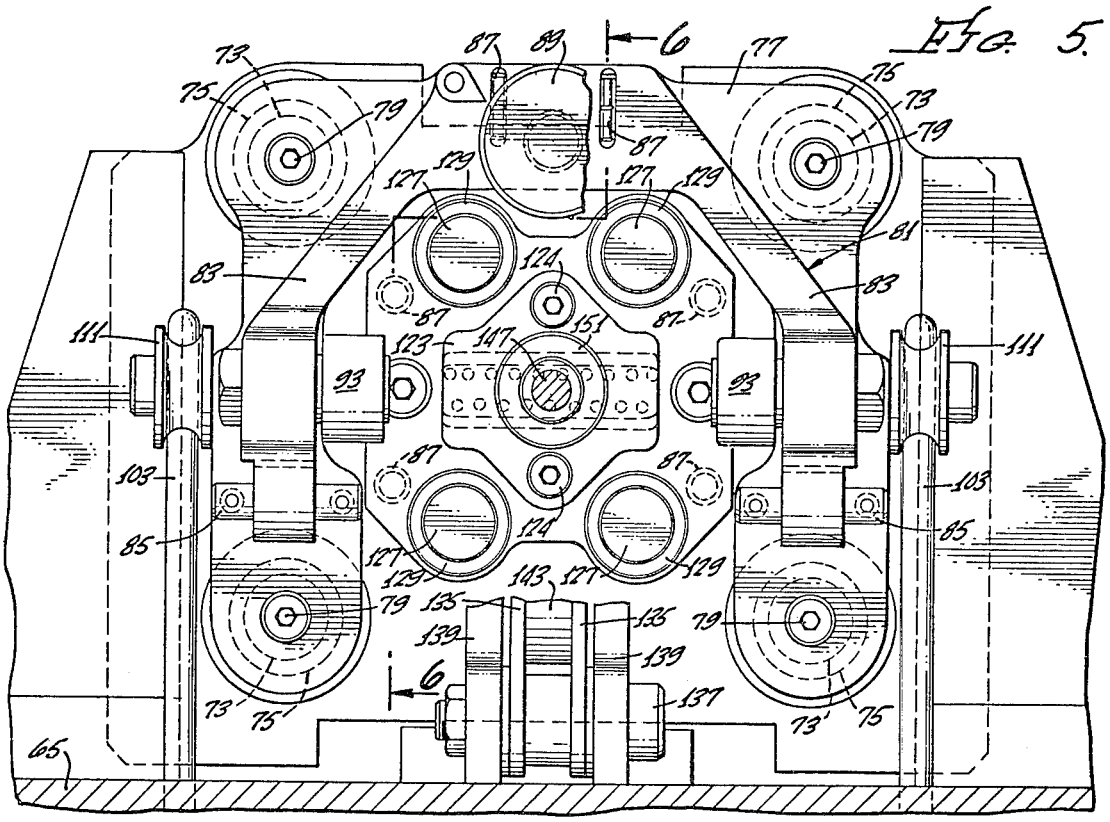
FIG. 5 is an enlarged fragmentary view partially in section taken generally along lines 5—5 of FIG. 3 and illustrating a portion of the mechanism for driving the core punch platen.

One advantage of the dual cams 95 is that the driving force from the cams is imparted to appropriately spaced locations on the plate 77 to prevent any tendency of the plate and the shafts 73 to tilt. As shown in FIG. 5, the pins 85 which pivotally attach the yoke 81 to the plate 77 are located in line with two of the shafts 73. The end portion 91 of the adjusting nut 89 also bears against the plate 77 along a line drawn between two of the shafts 73. Thus, an even pushing action on the plate 77 and the four shafts 73 is obtained.

The length of stroke of the core punches 11 is established by the contour of the identical cams 95. However, the ends of the stroke can be adjusted by turning the adjustment screw 89. For example, if the adjustment screw 89 is turned to pivot the yoke 81 counterclockwise as viewed in FIG. 6, the plate 77 and hence the core punches 11 are moved to the right relative to the cam 95, i.e., retracted. Upon subsequent rotation of the cams 95, the length of the stroke of the core punches 11 will be unaltered, but the core punches 11 will not advance as far into the core dies 35. The springs 87 maintain the end portion 91 in engagement with the plate 77.

One feature of this stroke adjustment mechanism is that limited pivotal movement of the yoke 81 about its pivot axis in response to turning of the adjusting screw 89 will not significantly alter the relationship between the cam 95 and the cam follower 93. Stated differently, turning of the adjusting screw 89 with the press 53 not operating will not significantly change the point of engagement of the cams 95 and the cam followers 93. If these points of contact were altered when making the adjustment, the timing relationship established by the cams 95 relative to other press movements described hereinabove would be altered. Adjustment of the yoke 81 with the adjusting screw 89 does very slightly alter the position of the cam follower 93 along the surface of the cam 95. However, the adjustments to the stroke of the core punches 11 are so small for the very small cores 45 that it causes no adverse effect on the timing the various press functions.

Another advantage of this construction is that the turning of the adjustment screw 89 automatically and simultaneously makes accurate, identical adjustments for both of the cams 95.

THE MOUNTING OF THE DIE PLATE

The die plate 13 is affixed by screws 113 (FIG. 7) to a main plate 115 (FIGS. 2 and 4). The air manifold 52 is also suitably affixed to the main plate 115. The main plate 115 is suitably affixed to the base 65 and is stationary with respect thereto. For example, the opposite vertical edges of the main plate 115 may be received and retained in slots 116 (FIG. 2) formed in upstanding brackets 117 (FIG. 2) which in turn are bolted to the base 65 by bolts 118.

THE APERTURE PUNCH DRIVE MECHANISM

Although the aperture punches 15 can be retained by the punch retainer 21 in any suitable manner, as shown in FIG. 4, the aperture punches 15 are mounted on an aperture punch platen 119 by a punch retainer 121 and a block 123. The block 123 is mounted on the platen 119 by fasteners 124. The punches 15 project through openings in the punch retainer 121, and the heads of the punches 15 are confined between the retainer 121 and the block 123. The punch retainer 121 is receivable in a cavity 125 in the main plate 115.

The aperture punch platen 119 is mounted for horizontal reciprocation by a plurality of horizontal parallel shafts 127 which are affixed to the main plate 115 and which project through bearing blocks and bearings 129 affixed to the platen 119. The shafts 127 are parallel to the shafts 73, and therefore the movements of the platens 119 and 69 are parallel. The aperture punch platen 119 is resiliently urged to the left as viewed in FIG. 4 by a plurality of springs 131 acting between the main plate 115 and the aperture punch platen. In this manner, the aperture punches 115 are mounted for reciprocating movement as described hereinabove in connection with FIGS. 1A–1E.

The aperture punch platen 119 is driven by the mechanism shown in FIG. 8. Specifically, a cam 133 is mounted on the shaft 97 for rotation with the shaft and with the cam 95. A lever 135 is mounted by a screw 137 on a bracket 139 for pivotal movement about a horizontal pivotal axis extending transverse to the direction of movement of the aperture punch platen 119. The bracket 139 is affixed to the base 65 in any suitable manner such as by a plurality of screws 141. A cam follower 143 is rotatably mounted on the lever 135 intermediate the ends thereof. A roller 145 is rotatably mounted on the outer end of the lever 135 and is engagable with a push rob 147 which is mounted at the upper end of the bracket 139 for horizontal reciprocating movement parallel to the shafts 127. A spring 149 urges the push rod 147 to the left as viewed in FIG. 8 and into tight engagement with the roller 145. The end of the push rod 147 remote from the roller 145 engages an adjustment screw 151 which is screwed into the block 123 (FIG. 4).

In operation, rotation of the cam 133 imparts movement to the cam follower 143 which pivots the lever 135 about the screw 137. The roller 145 pivots with the lever 135 to exert a pushing force on the push rod 147 which is transmitted to the aperture punches 15 through the adjustment screw 151, the block 123, and the aperture punch platen 119. The cam 133 drives the aperture punches 15 to the right as viewed in FIG. 4, i.e., advances the aperture punches and the springs 131 move the aperture punches 15 to the left, i.e., retract the aperture punches. The springs 131 and 149 assure that the cam follower 143 will remain in rolling contact with the cam 133.

The length of the stroke of the aperture punches 15 is fixed by the cam 133. However, by turning the adjustment screw 151, the starting and stopping locations for the stroke of the aperture punches 15 can be adjusted. The adjustment screw 151 constitutes variable length means for varying the position of the aperture punch platen 119 relative to the cam 133. For example, by turning the adjustment screw 151 outwardly to increase its effective length the aperture punch platen 119 is moved to the right as viewed in FIG. 4 whereby the stroke of the aperture punches 15 is correspondingly adjusted. Turning of the adjustment screw 151 does not result in pivotal movement of the lever 135. Accordingly, turning of the adjustment screw 151 does not change the location of the region of contact between the cam 133 and the cam follower 143.

THE STOCK FEEDING MECHANISM

The press 53 has a stock feeding mechanism 153 (FIGS. 3 and 9) for indexing the tape 17 in increments through the press. Although various stock feeding mechanisms could be employed, the stock feeding mechanism 153 is preferred because the rate of stock indexing can be adjusted while the press 53 is running.

The stock feeding mechanism 153 is driven by a cam 155 (FIGS. 2 and 3), a cam follower 157, a lever 159, and a link 161. The lever 159 is pivotally mounted by a pin 163 on a mounting bracket 165 which in turn is suitably mounted on the base 65. The cam follower 157 is rotatably mounted on the upper end of the lever 159, and the link 161 is pivotally connected to the lower end of the lever.

The stock feeding mechanism 153 includes end plates 167 and 169 suitably interconnected to form a frame (FIG. 9). An idler roll 171 is mounted on a shaft 173 by bearings 175. The shaft 173 extends between the end plates 167 and 169. The idler roll 171 is free wheeling.

A drive roll 177 is mounted closely adjacent the idler roll 171 so that the tape can be tightly gripped between the rolls. The shaft 173 extends through oversized slots 179 in the end plates 167 and 169 and is biased to the right as viewed in FIG. 9 by two springs 181. The biasing action of the springs 181 enables the rolls 171 and 177 to frictionally grip the tape 173 in response to movements of the shaft 173 in the slots 179. This actuation of the microswitch 183 can be utilized, for example, to provide an appropriate indication of the absence of the tape 17 from the stock feeding mechanism 153.

The drive roll 177 is mounted on a rotatable shaft 183 by bearings 187. The shaft 185 extends between the end plates 167 and 169. A one-way clutch 189 is also mounted on the shaft 185 for rotation with the shaft. When the clutch 189 is rotated counterclockwise as viewed in FIG. 3, it frictionally engages an annular surface 188 on the drive roll 177 to rotate the latter. When the shaft 185 rotates in the opposite direction, the clutch 189 does not drive the drive roll 177.

One end of the shaft 185 protrudes beyond the end plate 167 and has a lever, which may be in the form of a crank 191, suitably affixed thereto by a set screw 193. The crank 191 has an arm 195 which is pivotally joined to one end of the link 161 (FIG. 3) and another arm 197. A spring 199 (FIG. 3) is coupled to the arm 197 and to the base 65 to resiliently bias the crank 191 in a counterclockwise direction as viewed in FIG. 3. An abutment in the form of an eccentric 201 is mounted on a shaft 203 for rotational movement therewith. The shaft 203 is mounted on the end plates 167 and 169 and retained on the plates by a collar 205. The spring 199 urges the arm 197 counterclockwise as viewed in FIG. 3 into engagement with the eccentric 201. It also urges the link 161 to the left and this tends to pivot the lever 159 clockwise to move the cam follower 157 toward and/or into engagement with the cam 155.

In operation of the stock feeding mechanism 153, rotation of the cam 155 pivots the lever 159 counterclockwise thereby pivoting the crank 191 clockwise. The one-way clutch 189 (FIG. 9) does not transmit this clockwise motion to the drive roll 177 and, accordingly, the drive roll 177 does not rotate as the crank 191 is pivoted clockwise.

Ultimately, the cam 155 terminates the clockwise motion of the crank 191 and allows the crank to pivot in the counterclockwise direction. When this occurs, the spring 199 pivots the crank 191 counterclockwise and the one-way clutch 189 transmits this motion to the drive roll 177 to rotate the latter. Because the tape 17 is frictionally gripped between the drive roll 177 and the idler roll 171, rotation of the drive roll by the spring 199 pulls an increment of the tape 17 through the press 53. The counterclockwise movement of the crank 191 continues until the arm 197 is stopped by engagement with the eccentric 201. Thus the cam 155 cocks the crank 191 and the spring 199 provides the tape-feeding motion.

To adjust the length of the tape 17 which is indexed through the press 53 for each counterclockwise motion of the crank 191, the eccentric 201 is adjusted by manually turning the shaft 203 and then locking the shaft in the new angular position with an appropriate lock, such as a dial lock, (not shown). The angular position of the eccentric 201 can be adjusted while the press 53 is running. Thus, to increase the rate of feed the eccentric 201 is turned to increase the arc of the counterclockwise motion of the crank 191.

If the eccentric 201 is rotated to decrease the rate of feed, the lever 159 is pivoted through the link 161 to move the cam follower 157 away from the cam 155. Thus, for some angular positions of the eccentric 201, the cam follower 157 will not be in continuous contact with the cam 155 during a full revolution of the cam.

OVERALL OPERATION OF THE PRESS 53

The operation of the various subassemblies of the press 53 and of the tooling are set forth above and will not be repeated in detail. The cams 95 and 133 are programmed to provide movement of the core punches 11 and aperture punches 15 as described in connection with FIGS. 1A–1E. Of course, these programs can be varied depending upon the requirements of the parts being produced. Similarly, the cam 155 is appropriately contoured so that it will feed the tape 17 each time the tooling is in the position shown in FIG. 1E.

The tape 17 is pulled down through the press 53. As shown in FIG. 3, a tape support plate 207 is pivotally mounted on hinges 209. A roller 211 is rotatably mounted on the opposite end of the plate 207. The tape 17 is supported and guided by the plate 207 and the roller 211.

Both of the platens 69 and 119 and the die plate 13 are coupled to the main plate 115. Accordingly, the platens 69 and 119, the die plate 13, the plate 77, the yoke 81, and the adjustment screw 151 are removeable from the base 65 as a unit for repair, maintenance, and inspection by simply pulling the main plate 115 upwardly out of the slots 116.

Although exemplary embodiments of the invention have been shown and described, many changes, modifications and substitutions may be made by those skilled in the art without necessarily departing from the spirit and scope of this invention.

I claim:

1. A feeding mechanism for feeding material to a machine comprising:

a supporting structure;

a drive roll rotatably mounted on the supporting structure;

a second roll rotatably mounted on the supporting structure, said rolls being adapted to receive the material therebetween;

a drive lever;

means for mounting the drive lever for pivotal movement in both directions about a pivotal axis;

one-way clutch means for coupling said lever to said drive roll so that said lever drives said drive roll when the lever is pivoting in one of said directions about said pivot axis and does not drive the drive roll when the lever is pivoting in the other of said directions about said pivot axis whereby the rolls can cooperate to index the material;

a adjustable stop mounted on the supporting structure for limiting the pivotal movement of said drive lever in said one direction whereby the amount of the material which is indexed is controlled; and resilient means for driving said drive lever in said one direction.

2. A feeding mechanism as defined in claim 1 including means for drivingly coupling said drive lever to said machine so that said machine can drive said drive lever in said other direction.

3. A feeding mechanism for feeding material to a machine comprising:

a supporting structure;

a drive roll rotatably mounted on the supporting structure;

a second roll rotatably mounted on the supporting structure, said rolls being adapted to receive the material therebetween;

a drive lever;

means for mounting the drive lever for pivotal movement in both directions about a pivotal axis;

drive means for oscillating said lever about said pivotal axis;

one-way clutch means for coupling said lever to said drive roll so that said lever drives said drive roll when the lever is pivoting in a first direction about said pivot axis and does not drive the drive roll when the lever is pivoting in a second direction about said pivot axis whereby the rolls can cooperate to index the material;

means adjustable while the feeding mechanism is operating for varying the length of the stroke of the lever whereby the amount of material that is indexed for each operation of the lever can be adjusted while the feeding mechanism is running; and said drive means including mechanical drive means for moving said lever in one of said directions and resilient means for moving said lever in the other of said directions.

4. A feeding mechanism as defined in claim 3 wherein said mechanical drive means includes cam means for driving said lever in said second direction, said resilient means being adapted to drive said lever in said first direction, said adjustable means including an adjustable stop engageable with the lever for limiting the pivotal movement of said lever in said first direction.

5. A feeding mechanism as defined in claim 3 wherein said adjustable means includes an adjustable stop engageable with said lever to limit the pivotal movement thereof in one direction about said pivot axis.

* * * * *